US007416613B2

(12) United States Patent
Chou et al.

(10) Patent No.: US 7,416,613 B2
(45) Date of Patent: Aug. 26, 2008

(54) METHOD FOR COMPACTING MAGNETIC POWDER IN MAGNETIC FIELD, AND METHOD FOR PRODUCING RARE-EARTH SINTERED MAGNET

(75) Inventors: Tsutomu Chou, Tokyo (JP); Gouichi Nishizawa, Tokyo (JP); Masatoshi Hatakeyama, Tokyo (JP); Chikara Ishizaka, Tokyo (JP)

(73) Assignee: TDK Corporation, Tokyo (JP)

( * ) Notice: Subject to any disclaimer, the term of this patent is extended or adjusted under 35 U.S.C. 154(b) by 554 days.

(21) Appl. No.: 11/040,494

(22) Filed: Jan. 21, 2005

(65) Prior Publication Data

US 2005/0183792 A1 Aug. 25, 2005

(30) Foreign Application Priority Data

Jan. 26, 2004 (JP) ..... 2004-016594
Jan. 28, 2004 (JP) ..... 2004-019342

(51) Int. Cl.
*H01F 1/04* (2006.01)
*H01F 1/053* (2006.01)

(52) U.S. Cl. ..... 148/103; 148/302; 419/10; 419/38; 419/53

(58) Field of Classification Search ..... None
See application file for complete search history.

(56) References Cited

U.S. PATENT DOCUMENTS 4,678,634 A * 7/1987 Tawara et al. ..... 419/30
5,666,635 A 9/1997 Kaneko et al.
5,788,782 A * 8/1998 Kaneko et al. ..... 148/103
6,187,259 B1 * 2/2001 Yamashita et al. ..... 419/12
2003/0209842 A1 11/2003 Okumura et al.
2004/0241033 A1 * 12/2004 Ogawa et al. ..... 419/66

FOREIGN PATENT DOCUMENTS

| | | |
|---|---|---|
| CN | 1130289 A | 9/1996 |
| EP | 0706190 | 4/1996 |
| JP | 61-208809 | 9/1986 |
| JP | 05-234789 | 9/1993 |
| JP | 09-020953 | 1/1997 |
| JP | 09-097730 | 4/1997 |
| JP | 2003-193107 | 7/2003 |
| JP | 2004-002998 | 1/2004 |
| WO | 03/086687 | 10/2003 |

OTHER PUBLICATIONS

Chinese language office action for corresponding Chinese patent application No. 2005100057640 lists the references above.

* cited by examiner

*Primary Examiner*—John P. Sheehan
(74) *Attorney, Agent, or Firm*—Hogan & Hartson LLP

(57) ABSTRACT

A method for compacting a magnetic powder in a magnetic field comprising steps of filling a die with a magnetic powder, applying a pulsed magnetic field to the magnetic powder in the die to orientate the powder, and compressing the magnetic powder, wherein the pulsed magnetic field is applied twice or more when density ρ of a compacted body of said magnetic powder satisfies the relationship $\rho=\alpha\times H^{0.5}+\beta$($\alpha$=0.63 and $\beta$=1 to 2), where H is intensity (T) of the applied magnetic field.

4 Claims, 6 Drawing Sheets

FIG. 2

| No. | Applied magnetic field H (T) | Density of compacted body during application of magnetic field (upper column: packing density (g/cm$^3$), lower column: relative density (%)) | | | | | | | Br (kG) | Remarks |
|---|---|---|---|---|---|---|---|---|---|---|
| | | 1.6 | 2.0 | 2.4 | 2.6 | 3.0 | 3.4 | 4.0 | | |
| | | 21 | 26 | 32 | 34 | 39 | 45 | 53 | | |
| 1 | 1.4 | ○Twice | | | | | | | 13.21 | Comparative Example |
| 2 | | | | | | ○Twice | | | 13.26 | |
| 3 | | | | | ○ | ○ | | | 12.98 | |
| 4 | | | ○Twice | | | | | | 13.65 | Example |
| 5 | | | ○ | | ○ | | | | 13.66 | |
| 6 | 3.0 | | ○ | | | ○ | | ○ | 13.52 | Comparative Example |
| 7 | | | ○ | ○ | | | | | 13.55 | |
| 8 | | | | | | ○ | ○ | | 13.56 | |
| 9 | | | | | ○Twice | | | | 13.68 | Example |
| 10 | | | | | ○Reversed | | | | 13.70 | |
| 11 | | | | ○ | ○ | | | | 13.68 | |
| 12 | 6.0 | | ○ | ○ | | | | | 13.57 | Comparative Example |
| 13 | | | | | | | | ○Twice | 13.51 | |
| 14 | | | | | ○Twice | | | | 13.74 | Example |
| 15 | | | | | | ○ | ○ | | 13.75 | |
| 16 | | | | | | ○Reversed | | | 13.78 | |

FIG. 5

| No. | Density of compacted body during application of pulsed magnetic field ($g/cm^3$) | Applied magnetic field H (T) | Relative density (%) | Pulsed magnetic field type | Br (kG) | Remarks |
|---|---|---|---|---|---|---|
| 17 | 2.0 | 3.0 | 26.3 | Damped oscillation | 13.58 | Example |
| 18 | 2.6 | | 34.2 | | 13.75 | |
| 19 | 3.2 | | 42.1 | | 13.71 | |
| 20 | 3.6 | | 47.4 | | 13.00 | |
| 21 | 2.0 | | 26.3 | Single pulses | 13.21 | Comparative Example |
| 22 | 2.6 | | 34.2 | | 13.57 | |
| 23 | 3.2 | | 42.1 | | 13.38 | |
| 24 | 3.6 | | 47.4 | | 12.65 | |

METHOD FOR COMPACTING MAGNETIC POWDER IN MAGNETIC FIELD, AND METHOD FOR PRODUCING RARE-EARTH SINTERED MAGNET

BACKGROUND OF THE INVENTION

1. Field of the Invention

The present invention relates to a method for producing a rare-earth sintered magnet, more particularly to a method for compacting a magnetic powder in a magnetic field to improve magnetic orientation.

2. Description of the Related Art

In production of an anisotropic sintered Sm—Co or Nd—Fe—B system magnet, compacting is conducted in a magnetic field. It is important to improve the orientation of the magnetic powder when compacted in a magnetic field, in order to improve the residual magnetic flux density of the anisotropic sintered magnet. A more orientated magnet has a higher squareness, leading to higher residual magnetic flux density and magnetizability thereof.

Japanese Patent Laid-Open No. 61-208809 proposes production of an Nd—Fe—B system sintered magnet, wherein magnesium stearate is used as an additive and a pulsed magnetic field is applied while it is compacted.

Japanese Patent Publication No. 3,307,418 discloses a method for applying a pulsed magnetic field to a compacted body of magnetic powder while it has a relative density of 30 to 55%, discussing that it can have improved magnetic orientation even in the absence of a lubricant or a release agent, e.g., magnesium stearate.

SUMMARY OF THE INVENTION

As discussed above, compacting in a magnetic field in which a pulsed magnetic field is applied is an effective means for improving residual magnetic flux density of a rare-earth sintered magnet. It is an object of the present invention to provide a method for compacting a magnetic powder in a magnetic field and a method for producing a rare-earth sintered magnet, in both methods a pulsed magnetic field is used to further improve magnetic orientation.

The inventors of the present invention have confirmed, after having studied to achieve the above objects, that a pulsed magnetic field can further improve magnetic orientation by strictly controlling the relationship between magnetic field intensity and density of a compacted body to which a magnetic field is to be applied. The present invention, developed based on the above finding, comprises steps of filling a die with a magnetic powder, applying a pulsed magnetic field to the magnetic powder in the die to orientate the powder, and compressing the magnetic powder, the pulsed magnetic field is applied twice or more when density $\rho$ of a compacted body of the magnetic powder at least satisfies the relationship $\rho=\alpha\times H^{0.5}+\beta$($\alpha=0.63$ and $\beta=1$ to 2), where H is intensity (T) of the applied magnetic field.

The pulsed magnetic field for the present invention may be applied to a compacted body when the density thereof is uniform or varied. The pulsed magnetic field may have a single polarity or different polarities, but more preferably it is with different polarities and applied twice or more.

The preferable pulsed magnetic field for the present invention is a magnetic field with damped oscillation. The present invention, therefore, includes an embodiment of applying a pulsed magnetic field with damped oscillation twice or more. Also in this case, the magnetic field can be varied its polarity.

It is preferred in the present invention to apply a pulsed magnetic field having an intensity of 1T (absolute value) or more for 10 μs to 0.5 s for improving magnetic orientation.

The method for compacting a magnetic powder in a magnetic field according to the present invention is preferably applied to production of a rare-earth sintered magnet, where the starting magnetic powder to be compacted may be of an alloy powder for producing a rare-earth sintered magnet.

The method for compacting a magnetic powder in a magnetic field as which a pulsed magnetic field with damped oscillation is used is effective for improving magnetic properties of the magnet, in particular residual magnetic flux density (Br), irrespective of density of the compacted body to be sintered into the magnet, as discussed later in Examples. The present invention, therefore, provides a method for compacting a magnetic powder in a magnetic field, comprising steps of filling a die with a magnetic powder, applying a pulsed magnetic field with damped oscillation to the magnetic powder in the die to orientate the magnetic powder, and compressing the magnetic powder.

The method for compacting a magnetic powder in a magnetic field can include the above-described embodiments, e.g., use of a pulsed magnetic field showing damped oscillation with varying its polarity, and application of a pulsed magnetic field having an intensity of 1T (absolute value) or more for 10 μs to 0.5 s.

The method for compacting a magnetic powder in a magnetic field is applicable to production of a rare-earth sintered magnet. The present invention also provides a method for producing a rare-earth sintered magnet, comprising steps of compacting a magnetic powder in a magnetic field in which a pulsed magnetic field is applied to a compacted body of starting magnet powder, sintering the compacted body at a given temperature into a sintered body, and heat-treating the sintered body for aging, wherein the pulsed magnetic field is applied twice or more when density $\rho$ of the compacted body of starting magnet powder at least satisfies the relationship $\rho=\alpha\times H^{0.5}+\beta$($\alpha=0.63$ and $\beta=1$ to 2), where H is intensity (T) of the applied magnetic field.

It is preferable in the method for producing a rare-earth sintered magnet according to the present invention to apply a pulsed magnetic field to a compacted body, which is prepared by compressing a starting magnetic powder to have a given density, and to further compress the compacted body subsequent to application of the pulsed magnetic field so as to provide a compacted body to be sintered. It is also preferable to compress the compacted body in a transverse magnetic field, after application of the pulsed magnetic field is completed.

The pulsed magnetic field for the present invention is preferably the one with damped oscillation. The field with damped oscillation may vary in polarity.

The rare-earth sintered magnet to which the present invention is applicable is not limited. It is most preferable that the present invention is applied to production of an R-TM-B system sintered magnet (R represents one or more rare-earth elements, and TM represents Fe, or Fe and Co).

The present invention also provides a method for producing a rare-earth sintered magnet, comprising steps of compacting a starting magnet powder into a compacted body in a magnetic field, applying to the compacted body a pulsed magnetic field which continuously varies its polarity, sintering the compacted body at a given temperature into a sintered body, and heat-treating the sintered body for aging. The pulsed magnetic field preferably shows damped oscillation. It may be used in combination with a static magnetic field or another type of pulsed magnetic field.

The above method for producing a rare-earth sintered magnet can also include the above-described embodiments, e.g., compressing the compacted body after application of the pulsed magnetic field is completed, and application to production of an R-TM-B system sintered magnet (R represents one or more rare-earth elements, and TM represents Fe, or Fe and Co).

The present invention, as described above, can improve magnetic orientation by applying a pulsed magnetic field twice or more to a compacted body of adequate density, and consequently can improve residual magnetic flux density (Br) of the rare-earth sintered magnet. Moreover, the present invention can improve magnetic orientation, because a compacted body is compacted in a pulsed magnetic field which shows damped oscillation or varies in polarity. Still more, according to the present invention, compacting in a pulsed magnetic field with damped oscillation, can omit demagnetization as a post-treatment after compacting.

BRIEF DESCRIPTION OF THE DRAWINGS

FIG. 2 is a table showing the pulsed magnetic field conditions used in Example 1, and magnetic properties of the prepared rare-earth sintered magnets;

FIG. 5 is a table showing the compacting conditions in the magnetic field used in Example 2, and magnetic properties of the prepared rare-earth magnets.

DETAILED DESCRIPTION OF THE PREFERRED EMBODIMENTS

Figure 1:
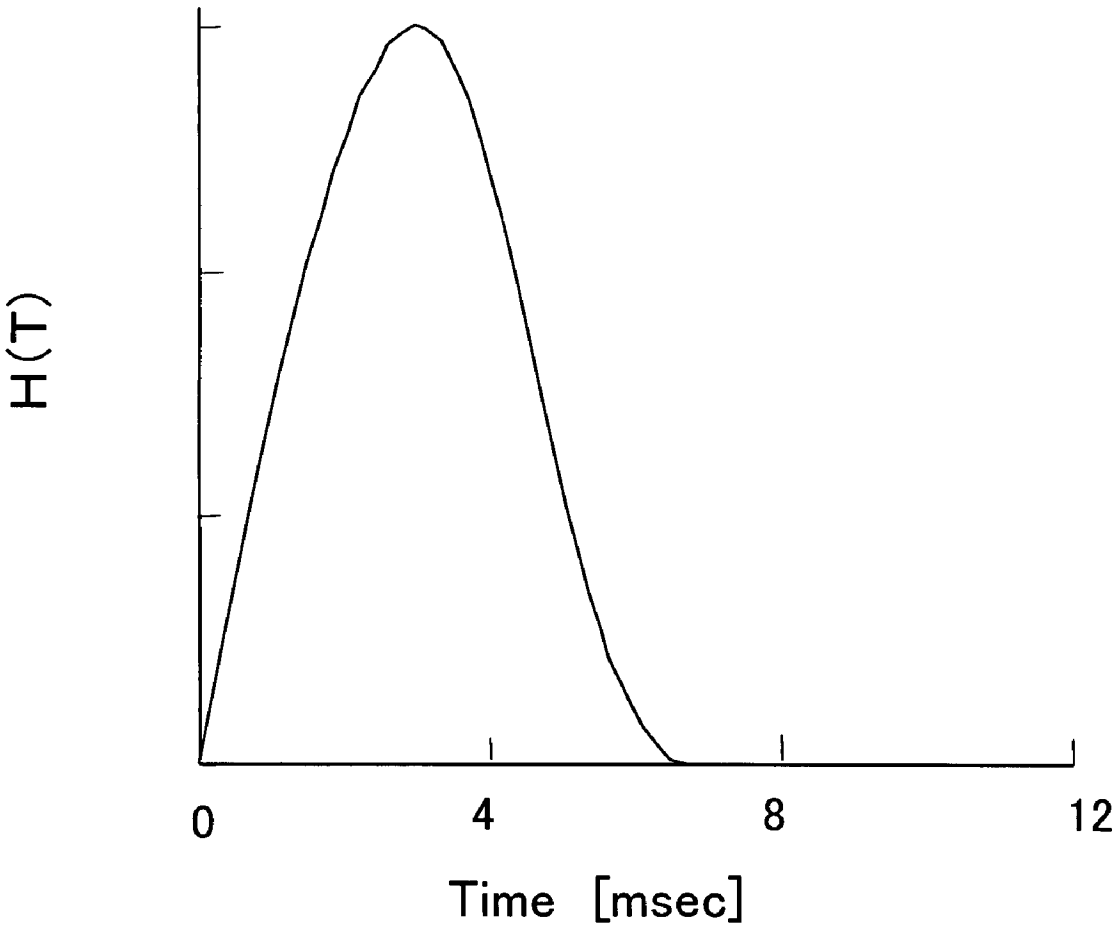
FIG. 1 shows a waveform of the pulsed magnetic field used in Examples 1 and 2.

The present invention will be described by specific embodiments.

Magnets Produced by the Present Invention

The present invention is applicable to production of R—TM—B system and R—Co system sintered magnets. The magnet composition is selected depending on specific purposes or the like.

When the present invention is applied to production of an R-TM-B system sintered magnet, the preferable magnet composition is R: 20 to 40%, B: 0.5 to 4.5% and TM: balance, all percentages being by weight. R represents a concept of including Y, and represents one or two elements selected from the group consisting of La, Ce, Pr, Nd, Sm, Eu, Gd, Tb, Dy, Ho, Er, Yb, Lu and Y. At an R content below 20% by weight, formation of the $R_2Fe_{14}B$ phase as the main phase for an R—TM—B system sintered magnet is not sufficient. Accordingly α-Fe or the like having soft magnetism is deposited and the coercive force significantly decreases. At an R content above 40% by weight, on the other hand, volume ratio of the $R_2Fe_{14}B$ phase as the main phase decreases leads to decrease residual magnetic flux density. Also, R reacts with oxygen to increase oxygen content of the magnet and decrease its coercive force because of decreased content of the R-rich phase, which is effective for generating coercive force. Therefore, the R content is set at 20 to 40% by weight. Since Nd is abundant as a source and relatively inexpensive, it is preferable to use Nd as a main component of R.

At a boron (B) content below 0.5% by weight, the magnet may not have a high coercive force. At a boron (B) content above 4.5% by weight, on the other hand, residual magnetic flux density tends to decrease. Therefore, its upper limit is set at 4.5% by weight. The preferable boron (B) content is 0.5 to 1.5% by weight.

An R—TM—B system rare-earth sintered magnet may be incorporated with an element M to form R—TM—B-M system one and further improve coercive force. The element M is at least one selected from the group consisting of Al, Cr, Mn, Mg, Si, Cu, C, Nb, Sn, W, V, Zr, Ti, Mo, Bi, Ag and Ga.

An R—Co system sintered magnet contains an R, at least one element selected from the group consisting of Fe, Ni, Mn and Cr, and Co. It is preferable that the magnet further contains Cu or at least one element selected from the group consisting of Nb, Zr, Ta, Hf, Ti and V, more preferably Cu and at least one element selected from the group consisting of Nb, Zr, Ta, Hf, Ti and V. Of these, particularly preferable ones are intermetallic compounds of Sm and Co, more preferably the one with an intermetallic compound of $Sm_2Co_{17}$ as the main phase and auxiliary phase mainly composed of $SmCo_5$ compound. A specific composition can be adequately selected in accordance with a production method and required magnetic properties. The preferable compositions include R: 20 to 30%, more preferably around 22 to 28%; at least one element selected from the group consisting of Fe, Ni, Mn and Cr: around 1 to 35%; at least one element selected from the group consisting of Nb, Zr, Ta, Hf, Ti and V: 0 to 6%, more preferably around 0.5 to 4%; Cu: 0 to 10%, more preferably around 1 to 10%; and Co: balance, all percentages by weight.

Description of the R—TM—B system and R—Co system sintered magnets above does not exclude application of the present invention to other rare-earth sintered magnets.

Starting Alloy

The starting alloy for the rare-earth sintered magnet maybe produced by, e.g., strip casting, where starting metals are melted in a non-oxidative atmosphere, e.g., Ar gas atmosphere, and the melt is provided onto a rotating roll and is solidified. The melt quenched by the roll is solidified into thin plates or flakes. The resulting alloy has a homogeneous microstructure, having a grain size of 1 to 50 μm. The alloy may be produced by other methods, for example, or the like, in addition to strip casting. The melt may be decanted over and solidified on a water-cooled copper plate in order to prevent its segregation. In addition, an alloy prepared by a reduction-diffusion process may be used as the starting alloy.

Crushing/Pulverizing Step

The starting alloy thus prepared is crushed to a given particle size. This step may comprise a crushing step and a pulverizing step.

The crushing may be carried out by hydrogen-assisted crushing or a crushing machine. In hydrogen-assisted crushing, a starting alloy is exposed to a hydrogen-containing atmosphere at room temperature to absorb hydrogen. The hydrogen-absorbing reaction, being exothermic, absorbs less hydrogen as the temperature increases. This may be prevented by some means, e.g., cooling the reactor.

The hydrogen-absorbed starting alloy is then heated and retained for dehydrogenation wherein hydrogen, which behaves as an impurity in a permanent magnet is decreased. It is heated to and retained at 200° C. or higher, preferably 350° C. or higher for at least 30 minutes, preferably 1 hour or more, although retention time varies depending on the retention temperature, starting alloy thickness or the like. The dehydrogenation treatment is carried out under vacuum or in a flow of Ar gas. It should be noted that the hydrogen-absorbing or dehydrogenation treatment is not essential for the present invention.

The crushing may be carried out by a crushing machine such as stamp mill, jaw crusher, brown mill or the like in an inert gas atmosphere.

The crushed alloy is then pulverized, normally by a jet mill to a mean particle size of around 1 to 10 μm. A fatty acid or its derivative, e.g., zinc stearate, calcium stearate, amide stearate or amide oleate as a stearate-or oleate-based acid, may be added to improve lubricity for the subsequent compacting step and orientation of the magnetic powder.

Compacting in Magnetic Field

The pulverized alloy is then compacted in a magnetic field. In the present invention, a pulsed magnetic field is applied in the compacting. The pulsed magnetic field can be produced by instantaneous discharge of charges stored in a condenser bank to a circuit comprising an air-core coil to allow a large quantity of current to pass through the coil in a moment.

In the present invention, the pulsed magnetic field is applied, when density p of the compacted body at least satisfies the relationship of the formula (1)

$$\rho=\alpha\times H^{0.5}+\beta(\alpha=0.63 \text{ and } \beta=1 \text{ to } 2) \quad (1)$$

where H is intensity (T) of the applied magnetic field. It is because the pulsed magnetic field gives a higher residual magnetic flux density (Br) to the magnet when the above relationship is satisfied than when it is not satisfied, as discussed later. Herein, magnetic field intensity is defined as pulse waveform peak.

It should be noted, however, that a pulsed or static magnetic field which does not satisfy the above relationship may be applied, provided that the a pulsed magnetic field satisfying the above relationship is applied twice or more.

In the present invention, the pulsed magnetic field satisfying the above relationship is applied twice or more, because a single application of the magnetic field may not sufficiently improve magnetic orientation. Each pulsed magnetic field should satisfy the above formula (1). In the present invention, the number of application of the pulsed magnetic field is defined as pulsed waveform peak number. Therefore, a pulsed magnetic field is applied a plurality of time, when it shows damped oscillation.

The intensity of each pulsed magnetic field may be constant or varied. For example, when a magnetic field having an intensity of 3T in the first application, a magnetic field to be applied subsequently may have an intensity of 3T, or lower or higher than 3T.

The polarity of a magnetic field to be applied may be single or varied. However, a pulsed magnetic field with different polarities can improve magnetic orientation more efficiently, because a magnetizing device has a polarity opposite to the N or S polarity of the magnetized powder, which generates a repulsive force to promote the movement of the powder.

Moreover, each pulsed magnetic field may be a magnetic field having a pulse waveform oscillating with varying polarity. Such a magnetic field tends to improve magnetic orientation, because the magnetic powder moves in the field in such a way to orientate an easily magnetizable crystal axis along the magnetic field direction. Intensity H of such a magnetic field is defined as the first oscillating peak.

Application of a pulsed magnetic field with damped oscillation is also effective for the present invention. Moreover, the pulsed magnetic field preferably shows damped oscillation with varying its porality. It is known, as disclosed by Japanese Patent Laid-Open No. 2000-182867, that a pulsed magnetic field with damped oscillation is used to demagnetize a compacted body compacted for an anisotropic bonded magnet in a magnetic field, as well as the die. However, use of such a pulsed magnetic field for producing a sintered magnet in the present invention is a novel approach. The above magnetic field used in the present invention improves magnetic orientation, because a magnetic powder (fine powder) moves in the field in such a way to orientate an easy magnetization axis of the powder along the magnetic field direction. The magnetic field further improves magnetic orientation when applied to the compacted body a pulsed magnetic field which continuously varies its polarity, because the magnetizing device has a polarity opposite to the N or S polarity of the magnetized powder, which generates a repulsive force to promote the movement of the powder.

It is preferable to apply a pulsed magnetic field having an intensity of 1T (absolute value) or more for 10 μs to 0.5 s, because it may not lead to a sufficient orientation, when compacted in a magnetic field having an intensity below 1T for 10 μs. On the other hand, application of a magnetic field having an intensity of 1T or more for longer than 0.5 s tends to generate excessive heat from the magnetic field-applying coil. It is therefore recommended in the present invention to apply a magnetic field having an intensity of 1T or more for 10 μs to 0.5 s. A pulsed magnetic field having an intensity of 1T or more may be applied for 10 μs to 0.5 s once or more times. Intensity of a pulsed magnetic field with damped oscillation slowly decreases after it is applied. It is needless to say that application of a magnetic field whose intensity decreases below 1T after it keeps an intensity of 1T or more for 10 μs to 0.5 s is still within the scope of the present invention.

The present invention is applicable to either compacting in the so-called transverse magnetic field in which the direction of compression is almost at a right angle to the applied field direction or compacting in the so-called vertical magnetic field in which both directions are substantially identical. A compacted body to be sintered is normally compressed further after the pulsed magnetic field according to the present invention is applied. The compression in a die may be replaced by cold isostatic pressing (CIP).

Compacting pressure in the magnetic field is in a range from 0.8 to 3 tons/cm$^2$ (80 to 300 MPa). It may be constant during the compacting process, or gradually increased or decreased. It may be even changed irregularly. Decreased compacting pressure increases magnetic orientation. However, a compacted body compacted at an excessively low pressure will have an insufficient strength and thereby cause handling-related troubles. Therefore, it is recommended to compact a compacted body at a pressure in the above range. When compacted in a magnetic field, a compacted body normally has a final relative density of 50 to 60%.

Sintering

A compacted body compacted in a magnetic field is sintered under vacuum or in a non-oxidative gas atmosphere. It is necessary to adjust sintering conditions in consideration of various conditions, e.g., composition, crushing (pulverizing) method, mean particle size and particle size distribution. It may be sintered at 900 to 1200° C. for around 1 to 10 hours.

Aging Treatment

The sintered compacted body can be treated for aging at or above 350° C. but below the sintering temperature. The aging treatment is an important step for controlling magnet coercive force. When this treatment is carried out in two stages, it is effective to retain the sintered body first around 800 to 900° C. and then around 450 to 600° C. for given periods of time. The sintered body can have an increased coercive force when treated around 800 to 900° C. When it is carried out in one stage, it is recommended to age the sintered body around 450 to 600° C., because it can have a greatly increased coercive force when treated around 450 to 600° C.

Formation of Overcoat (Protective Film)

An R—TM—B system sintered magnet is preferably coated with an overcoat, because it is not well resistant to corrosion. The method for forming the overcoat may be selected from known ones in consideration of the overcoat type. For example, when electroplating is adopted, it may be formed by the following steps by the common procedure:

Working of the sintered body→Barreling→Degreasing →Water washing→Etching (e.g., with nitric acid)→Water washing→Electroplating for forming the overcoat→Water washing→Drying

EXAMPLE 1

An alloy comprising Nd (29.5%), Co (0.5%), B (1%) and Fe (balance), all percentages by weight, were prepared by strip casting, and treated by hydrogen-assisted crushing where an alloy absorbed hydrogen at room temperature and thereafter were dehydrogenated at 600° C. for 1 hour in an Ar atmosphere. As an organic lubricant, 0.05% by weight of zinc stearate was added to the resulting powder, and mixed. Then it was pulverized by a jet mill to a mean particle size of 3.2 μm. The alloy had a true density of 7.6 g/cm$^3$.

The pulverized powder obtained was compacted in a magnetic field, in a state that a compressing die was filled with the pulverized powder and the powder was compressed by lowering an upper punch equipped with the compressing die to have a given density, then a given pulsed magnetic field was applied to a compacted body obtained, thereafter the compacted body was further compressed. So-called transverse magnetic field in which the direction of compression was almost at a right angle to the applied magnetic field direction, was employed.

A total of seven density levels prepared were 1.6 g/cm$^3$, 2.0 g/cm$^3$, 2.4 g/cm$^3$, 2.6 g/cm$^3$, 3.0 g/cm$^3$, 3.4 g/cm$^3$ and 4.0 g/cm$^3$.

Magnetic field intensity (H) applied were 1.4T, 3.0T and 6.0T. FIG. 1 shows the waveform of the pulsed magnetic field applied. When the pulsed magnetic field was applied twice or more, the same magnetic field having the same waveform (intensity) shown in FIG. 1 was used. When a pulsed magnetic field with different polarities was used, the pulsed magnetic field having a waveform shown in FIG. 1 was followed by the same waveform but opposite in polarity.

The powder was subjected to the pulsed magnetic field and further compressed by the upper punch at a compacting pressure of 1.4 tons/cm$^2$ into a compacted body having a density of 4.4 g/cm$^3$, both in Example and Comparative Example. The resulting compacted body was sintered at 1040° C. for 4 hours under vacuum, and then treated for aging at 900° C. for 1 hour and 450° C. for 1 hour in an Ar atmosphere.

The rare-earth sintered magnet thus prepared was measured for its residual magnetic flux density (Br) using a B—H tracer. The results are shown in FIG. 2, where an open circle in the "density of compacted body" column means that the pulsed magnetic field was applied to the compacted body having the corresponding density, the term "twice" behind the open circle means that the pulsed magnetic field was applied twice to the compacted body having the same density, and the term "reversed" behind the open circle means that the pulsed magnetic field was applied twice, first with one polarity and secondly with another polarity.

As shown in FIG. 2, the compacted body having a density of 2.0 g/cm$^3$ or 2.6 g/cm$^3$ had a higher residual magnetic flux density (Br) than the other compacted bodies, when they were subjected twice or more to a pulsed magnetic field having an intensity of 1.4T.

Then, the compacted body having a density of 2.4 g/cm$^3$ or 2.6 g/cm$^3$ had a higher residual magnetic flux density (Br) than the other compacted bodies, when they were subjected twice or more to a pulsed magnetic field having an intensity of 3.0 T.

Further, the compacted body having a density of 2.6 g/cm$^3$, 3.0 g/cm$^3$ or 3.4 g/cm$^3$ had a higher residual magnetic flux density (Br) than the other compacted bodies, when they were subjected twice or more to a pulsed magnetic field having an intensity of 6.0T.

These results indicate that there is an adequate density of compacted body for a pulsed magnetic field intensity to improve magnetic orientation, or residual magnetic flux density (Br).

The above effect can be realized when a pulsed magnetic field is applied twice or more to a compacted body of a uniform density (e.g., Sample No. 4 in FIG. 2) and also when applied to a compacted body of a varying density (e.g., Sample No. 5 in FIG. 2).

It is also observed that a pulsed magnetic field with different polarities (e.g., Sample No. 10 in FIG. 2) gives a higher residual magnetic flux density (Br) than a pulsed magnetic field of single polarity (e.g., Sample No. 9 in FIG. 2).

Figure 3:
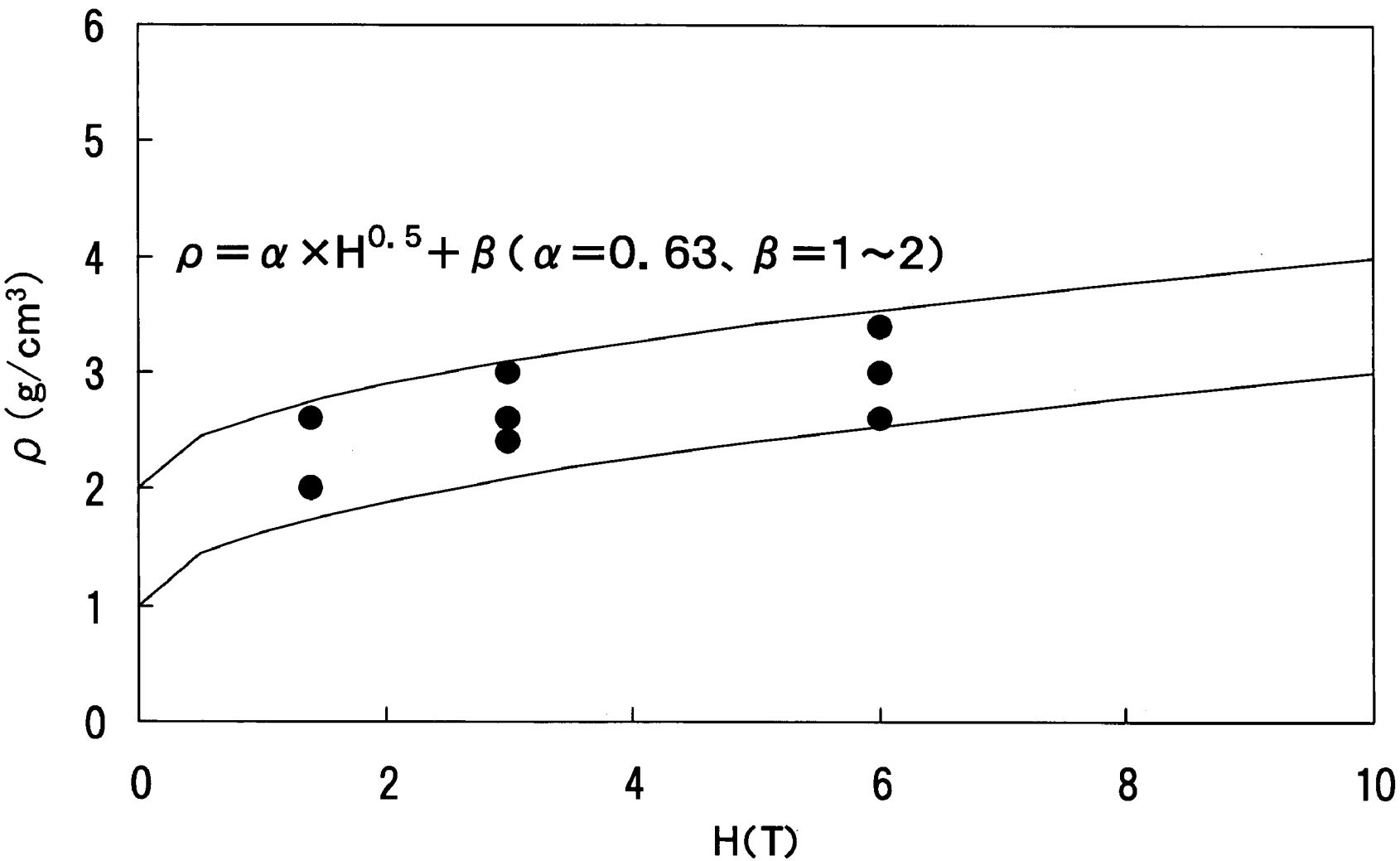
FIG. 3 is a graph showing the relationship between intensity of pulsed magnetic field (H) applied to the compacted body in Example 1 and density of compacted body subjected to such a pulsed magnetic field.

FIG. 3 plots packing density (g/cm$^3$) on the vertical axis against magnetic field intensity H (T) on the horizontal axis, based on the results of the present invention given in FIG. 2, where the solid lines define the range of the relationship defined by the formula (1) according to the present invention:

$$\rho=\alpha\times H^{0.5}+\beta(\alpha=0.63 \text{ and } \beta=1 \text{ to } 2) \quad (1)$$

As shown there, the sintered magnets having a high residual magnetic flux density fall within the range of the formula (1). It is therefore desirable to compact a magnetic powder in a magnetic field while keeping the relationship defined by the general formula (1) of the present invention in production of a rare-earth sintered magnet.

EXAMPLE 2

An alloy comprising Nd (29.5%), Co (0.5%), B (1%) and Fe (balance), all percentages by weight, were prepared by strip casting, and treated by hydrogen-assisted crushing where an alloy absorbed hydrogen at room temperature and thereafter were dehydrogenated at 600° C. for 1 hour in an Ar atmosphere. As an organic lubricant, 0.05% by weight of zinc stearate was added to the resulting powder and mixed, and then pulverized by a jet mill to a mean particle size of 3.6 μm.

The pulverized powder obtained was compacted in a magnetic field, in a state that a compressing die was filled with the pulverized powder and the powder was compressed by lowering an upper punch equipped with the compressing die to have a given density, then a given pulsed magnetic field was applied to a compacted body obtained, thereafter the compacted body was further compressed. So-called transverse magnetic field in which the direction of compression was almost at a right angle to the applied magnetic field direction, was employed.

A total of four density levels prepared, were 2.0 g/cm$^3$, 2.6 g/cm$^3$, 3.2 g/cm$^3$ and 3.6 g/cm$^3$.

Figure 4:
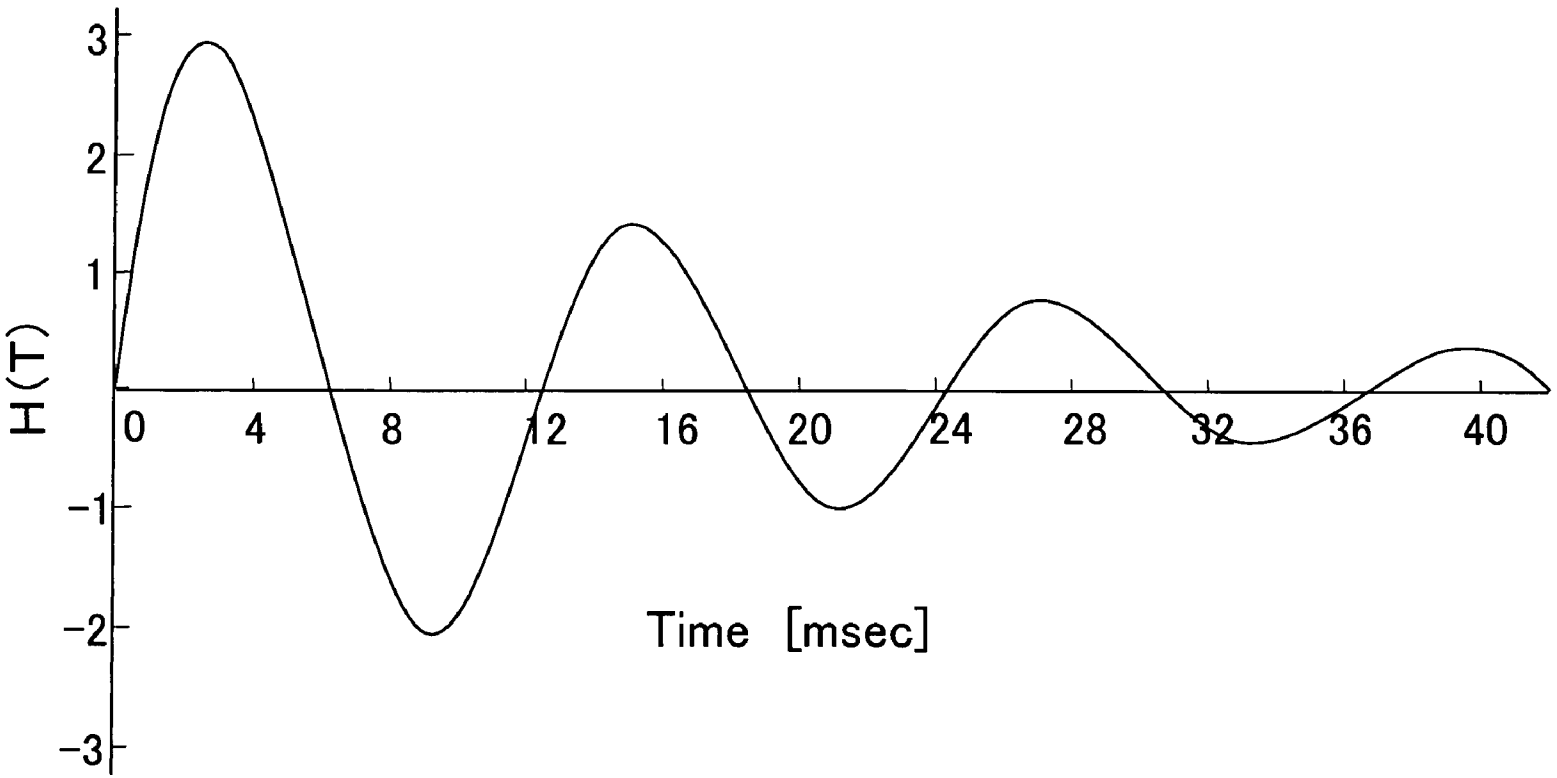
FIG. 4 shows a waveform of the pulsed magnetic field used in Example 2.

Two types of magnetic field were used, one illustrated in FIG. 4 and the other in FIG. 1. The pulsed magnetic field shown in FIG. 4 has damped oscillations, and waveforms with different polarities which continuously varying. The pulsed magnetic field shown in FIG. 1, on the other hand, comprises a waveform having the single peak. These fields shown in FIGS. 4 and 1, had the same intensity of 3T.

After the pulsed magnetic field shown in FIGS. 4 and 1 was applied, the powder was compacted by an upper punch at a compacting pressure of 1.4 tons/cm$^2$ into a compacted body having a density of 4.4 g/cm$^3$. The resulting compacted body was sintered at 1050° C. for 4 hours under vacuum, and then treated for aging at 900° C. for 1 hour and 450° C. for 1 hour in an Ar atmosphere. The compacted body compacted in the pulsed magnetic field with damped oscillation was able to be easily released from the die without needing a separate demagnetization step, because the compacted body and die were already demagnetized when applied to the field of damped oscillation.

The rare-earth sintered magnet thus prepared was measured for its residual magnetic flux density (Br) using a B—H tracer. The results are shown in FIGS. 5 and 6.

Figure 6:
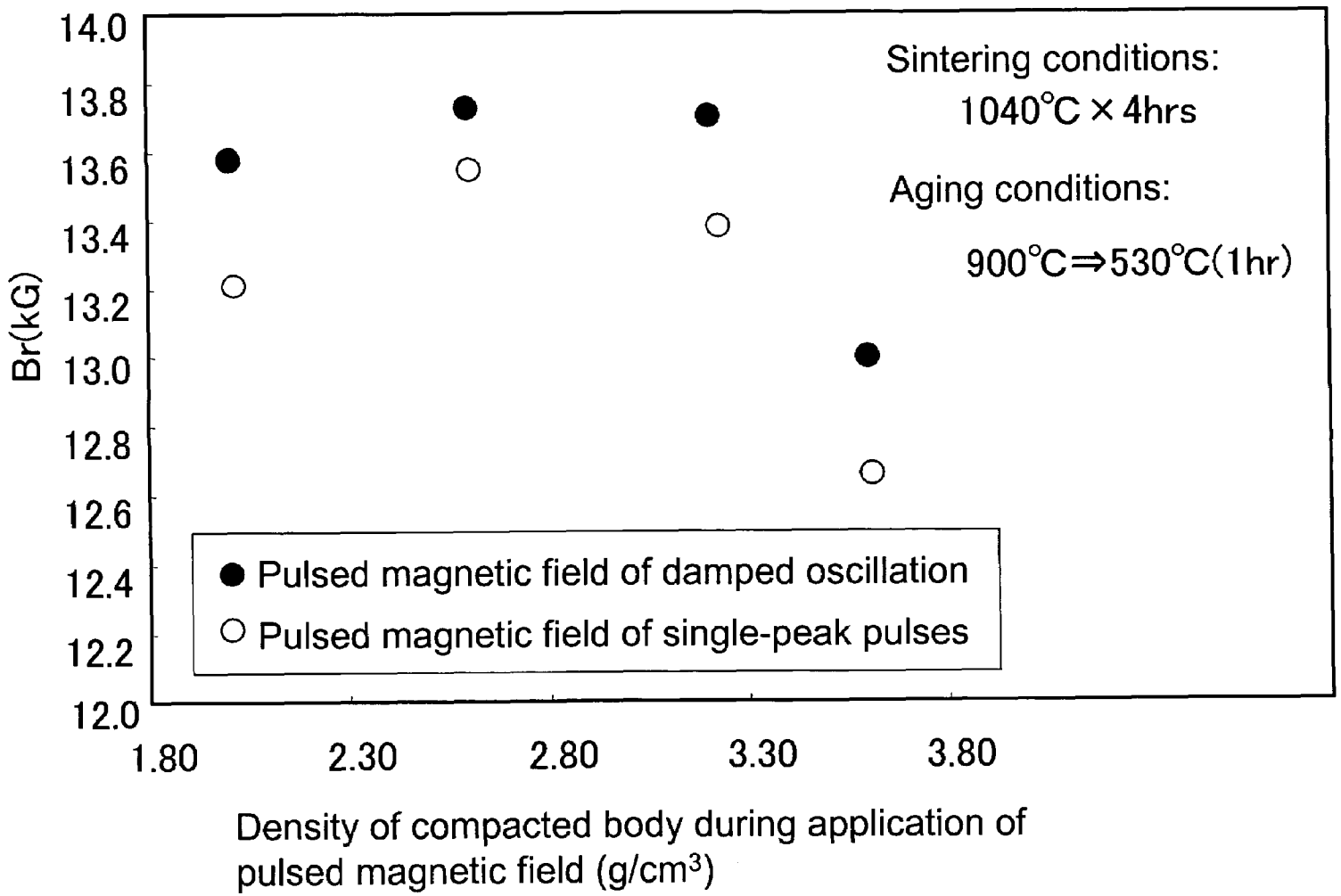
FIG. 6 is a graph showing the relationship between density of compacted body during application of pulsed magnetic field and residual magnetic flux density with regard to Example 2.

As shown in FIGS. 5 and 6, the pulsed magnetic field with damped oscillation or the pulsed magnetic field which continuously varies its polarity, gives a higher residual magnetic flux density (Br) than the single-peak pulse of the magnetic field, irrespective of density of the compacted body to which the pulsed magnetic field is applied. These results indicate that a pulsed magnetic field which continuously varies its polarity is advantageous for improving magnetic orientation.

It is also observed that the residual magnetic flux density (Br) attains a maximum value when a pulsed magnetic field is applied to the compacted body having a density of 2.6 g/cm$^3$, which suggests that it is necessary to select a density of the compacted body applied to a pulsed magnetic field in improving magnetic orientation by applying a pulsed magnetic field. The compacted body having a density $\rho(=\alpha\times H^{0.5}+\beta(\alpha=0.63$ and $\beta=1$ to 2)) for the present invention is in a range from 2.1 to 3.1 g/cm$^3$. The compacted body having a density of 2.6 g/cm$^3$ and applied to a pulsed magnetic field satisfies the above relationship for the rare-earth sintered magnet. The density corresponds to a relative density of 30 to 40%.

What is claimed is:

1. A method for producing a rare-earth sintered magnet, comprising the steps of:

compacting a magnetic powder in a magnetic field in which a pulsed magnetic field with damped oscillation is applied to a compacted body of starting magnet powder, sintering said compacted body at a given temperature into a sintered body, and heat-treating said sintered body for aging, wherein:

said pulsed magnetic field with damped oscillation is applied twice or more when density $\rho$ of said compacted body of starting magnet powder at least satisfies the relationship $\rho=\alpha\times H^{0.5}+\beta(\alpha=0.63$ and $\beta=1$ to 2), where H is intensity (T) of the applied magnetic field.

2. The method for producing a rare-earth sintered magnet according to claim 1, wherein:

said pulsed magnetic field with damped oscillation is applied to said compacted body prepared by compressing said starting magnetic powder to have a given density, and said compacted body is further compressed after application of said pulsed magnetic field with damped oscillation is completed.

3. The method for producing a rare-earth sintered magnet according to claim 1 wherein:

said rare-earth sintered magnet is of an R—TM—B system one where R represents one or more rare-earth elements, and TM represents Fe, or Fe and Co.

4. The method for producing a rare-earth sintered magnet according to claim 1 wherein said pulsed magnetic field with damped oscillation varies its polarity.

* * * * *